US007252485B2

(12) United States Patent
Ito

(10) Patent No.: US 7,252,485 B2
(45) Date of Patent: Aug. 7, 2007

(54) TUBE TYPE PUMPING APPARATUS

(75) Inventor: Hideaki Ito, Nagano (JP)

(73) Assignee: Nidec Sankyo Corporation, Nagano (JP)

( * ) Notice: Subject to any disclaimer, the term of this patent is extended or adjusted under 35 U.S.C. 154(b) by 736 days.

(21) Appl. No.: 10/676,462

(22) Filed: Sep. 30, 2003

(65) Prior Publication Data

US 2004/0131487 A1 Jul. 8, 2004

(30) Foreign Application Priority Data

Oct. 2, 2002 (JP) ..... 2002-289910
Oct. 2, 2002 (JP) ..... 2002-289911

(51) Int. Cl.
*F04B 43/12* (2006.01)

(52) U.S. Cl. ..... 417/477.3; 417/477.8

(58) Field of Classification Search ..... 417/477.3, 417/477.8

See application file for complete search history.

(56) References Cited

U.S. PATENT DOCUMENTS 419,461 A * 1/1890 Lee ..... 417/477.8
3,447,478 A * 6/1969 Clemens ..... 417/477.8
4,070,725 A * 1/1978 Austin et al. ..... 417/477.8
4,441,867 A * 4/1984 Berelson ..... 417/477.8
4,586,882 A * 5/1986 Tseng ..... 417/477.3
4,705,464 A * 11/1987 Arimond ..... 417/477.8
5,586,873 A * 12/1996 Novak et al. ..... 417/477.8
6,203,295 B1 * 3/2001 Nishioka ..... 417/477.8
6,203,296 B1 * 3/2001 Ray et al. ..... 417/477.8
6,641,249 B2 * 11/2003 Miyauchi ..... 417/477.8
6,733,255 B2 * 5/2004 Ota et al. ..... 417/477.8

FOREIGN PATENT DOCUMENTS

JP 2003-201975 7/2003

* cited by examiner

*Primary Examiner*—Michael Koczo, Jr.
(74) *Attorney, Agent, or Firm*—Reed Smith LLP

(57) ABSTRACT

A tube type pumping apparatus having a resilient tube provided along a wall, a squeezing member positioned to move along the wall to squeeze the resilient tube against the wall, a squeezing member holder that holds the squeezing member; a cam member whose surface receives a driving force from a driving source to change positions of the squeezing member between an initial position away from the wall and a squeezing position near the wall, and a regulating force generator that provides a regulating force to the squeezing member at a transition time interval as the squeezing member moves from the initial position to the squeezing position. The regulating force generator and the cam member acting together to prevent the squeezing member from applying pressure against the resilient tube during the transition time interval. The squeezing member has a curved surface to maintain an alignment of the tube with the squeezing member.

15 Claims, 6 Drawing Sheets

TUBE TYPE PUMPING APPARATUS

CROSS-REFERNCE TO RELATED APPLICATIONS

This application claims priority to Japanese patent applications Nos. 2002-289910 and 2002-289911, both filed on Oct. 2, 2002, which are incorporated herein by reference.

TECHNICAL FIELD

The present invention relates to a tube-type pumping apparatus and, in particular, a pumping apparatus that transports fluid as a squeezing member moves along a resilient tube by applying pressure on the tube.

RELATED ART

A tube pump that transports liquid through a tube by moving a squeezing member, such as a roller, along an elastic tube with continuous squeezing of the elastic tube has a variety of applications in foods, cosmetics, pharmaceuticals and chemicals.

Generally, this type of pumping apparatus is constructed with a cam member for transmitting a driving force from a driving source and a roller support that supports a roller for applying a force to squeeze a tube, and works in such a manner that the roller moves from an initial position to a squeezing position utilizing the cam surface.

Nevertheless the cam member and roller supporting member should not rotate together when the roller position is changed utilizing the cam surface in a cam mechanism. To prevent the cam body and the roller supporting member from rotating together, friction is generated at the roller supporting member.

As the edge of the roller squeezes an elastic tube, stress is applied to the point where the resilient tube is bent and the tube wears out to cause cracking or tearing thereof.

In light of the above, the objective of the present invention is to provide a tube type pumping apparatus in which a cam ensures deformation of a squeezing member utilizing a large sized motor, suppressing temperature increase, and preventing a cam member and a roller supporting member from rotating together.

In addition, the present invention provides a configuration that can provide a durable elastic tube for a tube type pumping apparatus.

SUMMARY OF THE INVENTION

To overcome the problem, the present invention provides a tube type pumping apparatus comprising: a wall; a resilient tube, provided along the wall, whose internal hollow space provides a passage; a squeezing member arranged in such a manner that the resilient tube is sandwiched between the squeezing member and the wall such that the resilient tube is squeezed as the squeezing member moves along the wall, thereby transporting liquid through the resilient tube. The tube type pumping apparatus further comprises: a squeezing member holder for holding the squeezing member in such a manner that the squeezing member can change its position between a squeezing position near the wall and an initial position away from the wall; a cam member whose surface receives a driving force from a driving source to change positions of the squeezing member between the squeezing position near the wall and the initial position away from the wall; an engagement mechanism, which causes the squeezing member holder and the cam member to move in a corresponding manner after a given idle time elapses as the cam member begins to move; and a regulating force generator that provides a regulating force to the squeezing member holder at an interval as the squeezing member moves.

In the present invention, the regulating force generation means applies the regulating force to the squeezing member holder at intervals. In other words, the regulating force works when the timing is right. Until the timing is right, there is a possibility that the squeezing member holder rotates with the cam member during the period in which the cam (surface) moves the squeezing member from the initial position to the squeezing position. However, the duration of such a mutual rotation between squeezing member holder and the cam member is limited to the period defined by the moment of right timing and the moment the regulating force begins working, which is negligibly short. In addition, the regulating force works at intervals; minimizing the torque applied to the motor; eliminating the need for the use of a larger size (power) motor; and a significant increase in motor temperature. Further, the regulating force generating means generates a regulating force at intervals, minimizing wear of the friction generation portion that generates the regulating force. Reliability of the system is thus improved.

Also in the present invention, the squeezing member holder is, for example, a rotary member having a pair of supporting plates that supports a roller with the squeezing member, therebetween. In this configuration, the resilient tube and the wall are arranged around the squeezing member holder.

Further in the present invention, the regulating force generation means, for example, is constructed with a regulating projection, which projects from the squeezing member holder toward the outer circumference and a spring member, which resiliently contacts the regulating projection around the squeezing member holder.

Preferably, in the present invention, the squeezing member holder holds (multiple) rollers distanced from each other in a circumferential direction; the regulating projection is provided near the points where the rollers are supported; the spring member is arranged at a point away from the region within which the roller squeezes the resilient tube around the squeezing member holder. In this configuration, even though the timing for applying the regulating force squeezing member arrives while the squeezing member still moves squeezing the resilient tube, at least one roller is away from the region in which the resilient tube is squeezed. The load applied to the motor at the moment when the regulating force is generated is minimized.

Further in this configuration, it is desirable that one of the rollers should generate a regulating force in the direction in which the roller is pushed against the resilient tube. This configuration allows the spring member to push the roller, which then squeezes the resilient tube and the spring member absorbs the rebound from the resilient tube.

To overcome the problems, the present invention provides a tube type pumping apparatus comprising: a wall; a resilient tube, provided along the wall, whose internal hollow space provides a passage; a squeezing member arranged in such a manner that the resilient tube is sandwiched between the squeezing member and the wall such that the resilient tube is squeezed as the squeezing member moves along the wall, thereby transporting liquid through the resilient tube; wherein the squeezing member has a squeezing surface with a curvature; the resilient tube being provided with a tube position regulating means for keeping the resilient tube in the center of the squeezing surface in the width (horizontal) direction when the squeezing member squeezes the resilient tube.

In the present invention, the squeezing surface of the squeezing member has a curvature and a tube position regulating means for keeping the position of the resilient tube in the center of the squeezing surface in the width (horizontal) direction. As a result, the resilient tube is not squeezed at the edges or a raised portion of the squeezing member. The stress generated at edges of the resilient tube during squeezing is thus released, thereby enhancing the life of the resilient tube.

Preferably, in the present invention, the tube position regulating means is arranged at both the front end and the back end in the forward direction of the squeezing member. By keeping the resilient tube at these positions, the resilient tube is kept at the center in the width [sic, horizontal] direction of the squeezing surface for sure, thereby further increasing lifetime of the resilient tube.

The present invention can be applied to, for example, a tube type pumping apparatus comprising: a squeezing member holder for supporting the squeezing member in such a manner that the squeezing member can change its position between a squeezing position near the wall and an initial position away from the wall; and a cam member that transmits a driving force generated by a driving source to its surface whereby moving the squeezing member between the squeezing position and the initial position.

Alternately, the present invention can be configured as follows: when the squeezing member holder has a pair of supporting plates having an elongated hole elongated in a radial direction, for example, to which ends of rotary center axis of the roller are fitted, and the resilient tube and the wall are arranged around the pair of supporting plates that are facing each other, projections pointing downward may be provided on each of the facing surfaces of the pair of supporting plates as a tube position regulating means. In the tube type pumping apparatus thus configured, the cam member has a pair of end plates facing each other putting a pair of supporting plates therebetween. In addition, the end plates have the cam surface formed in such a manner that both ends of the rotary shaft slides thereon. Further, an engagement mechanism, provided at a point between the cam member and the squeezing holder causes the squeezing member holder and the cam member to move in a corresponding manner after a given idle time elapses as the cam member begins to move; such that the rollers move along the resilient tube and the wall after the rollers move from the initial position to the squeezing position.

DETAILED DESCRIPTION OF THE INVENTION

Embodiments of the present invention are described herein with reference to the drawings.

Figure 1A:
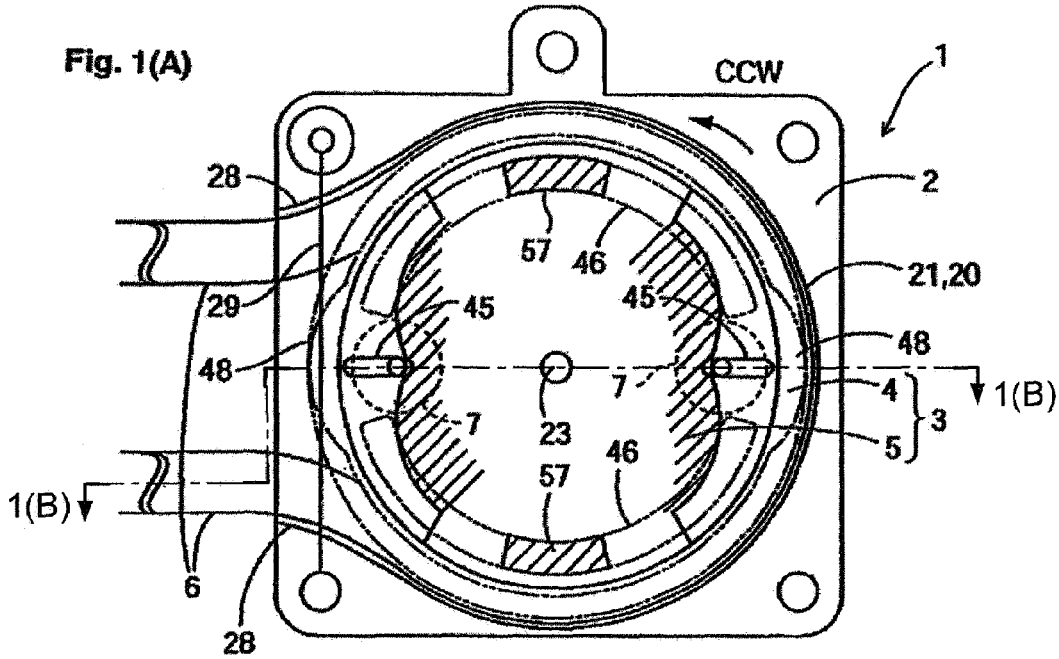
FIG. 1(A) is a plan view illustrating the configuration of the major section of the tube type pumping apparatus to which the present invention is applied.
Figure 1B:
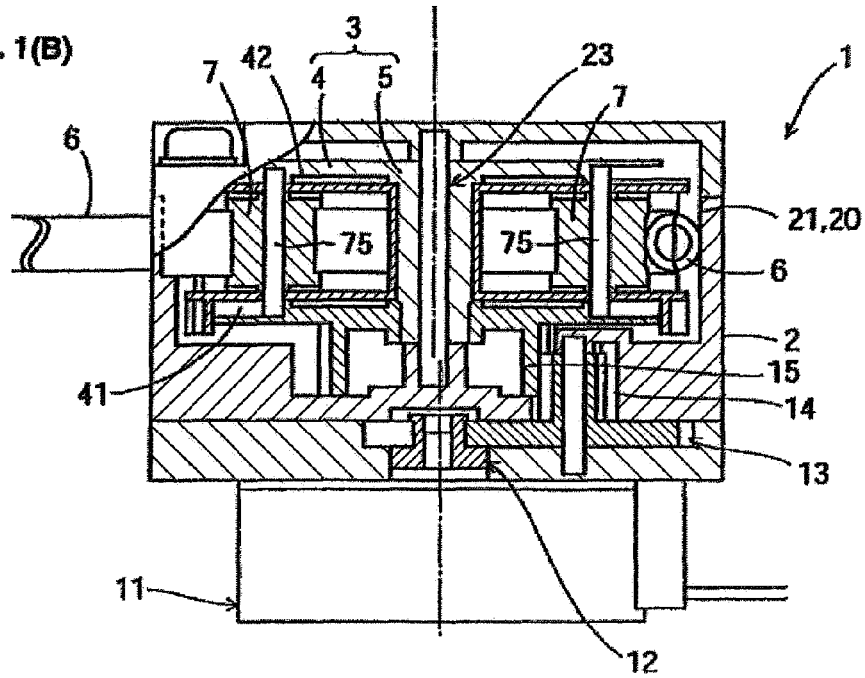
FIG. 1(B) is a cross section of the pumping apparatus.
Figure 2:
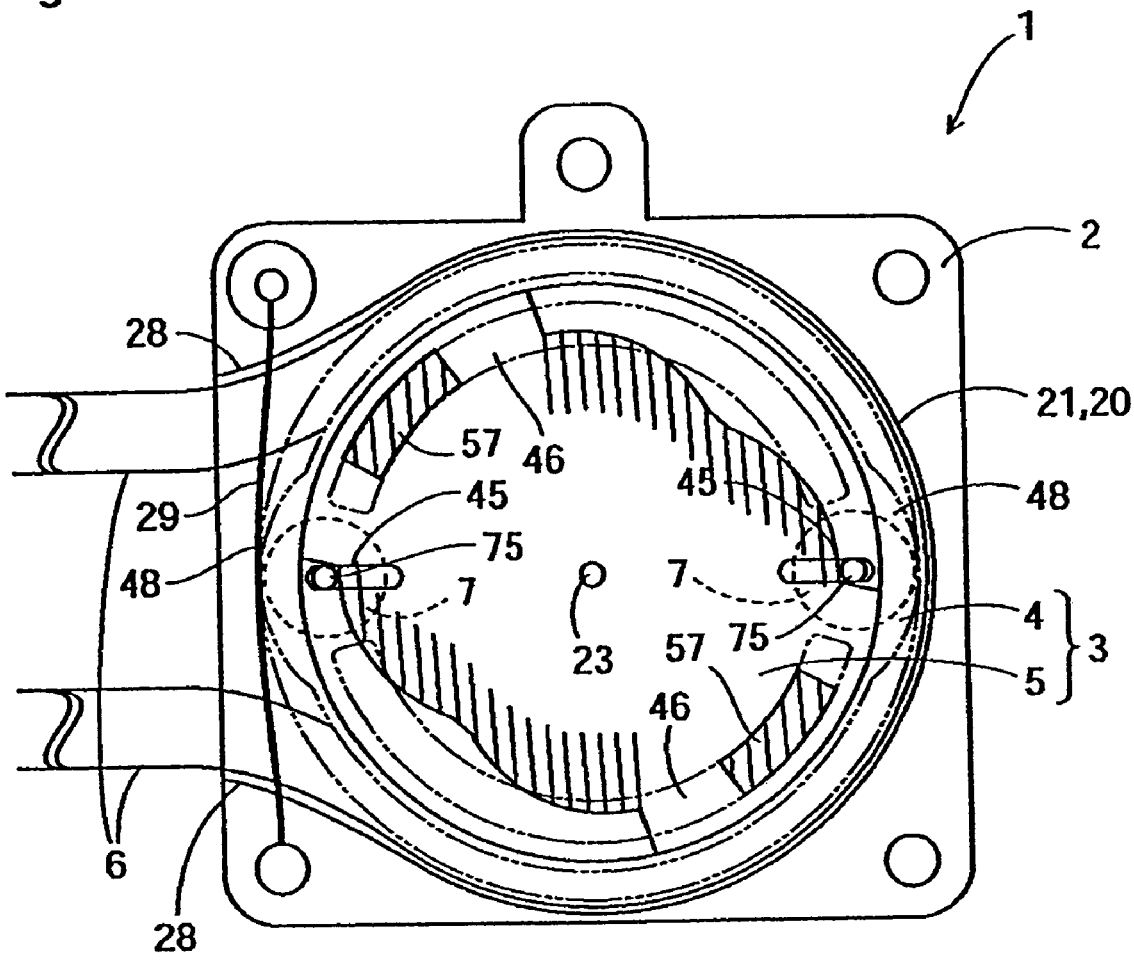
FIG. 2 is a diagram illustrating the pumping apparatus of FIG. 1(A) in the state in which liquid transport is about to begin.
Figure 3:
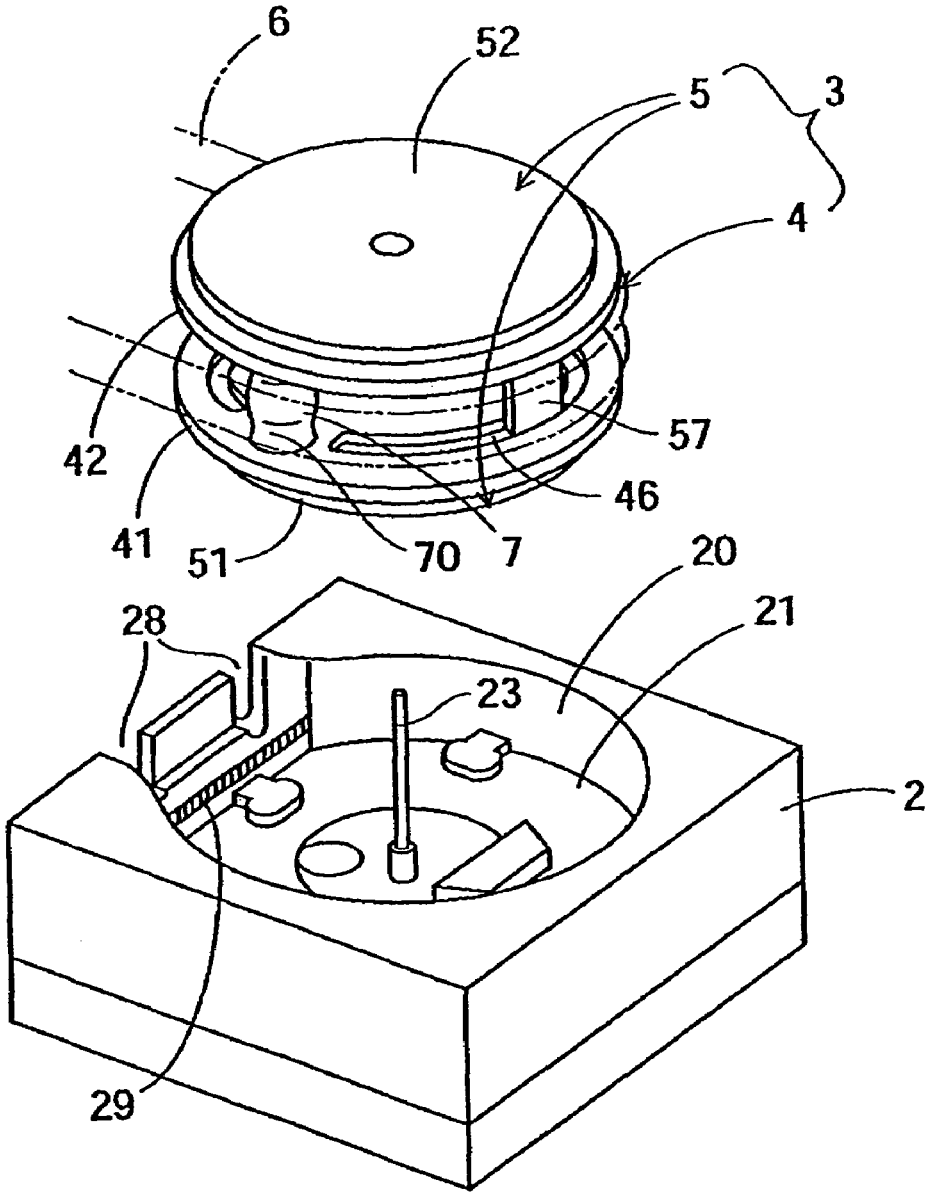
FIG. 3 is a perspective view of the tube type pumping apparatus of FIG. 1 disassembled into a casing and a rotor.
Figure 4A:
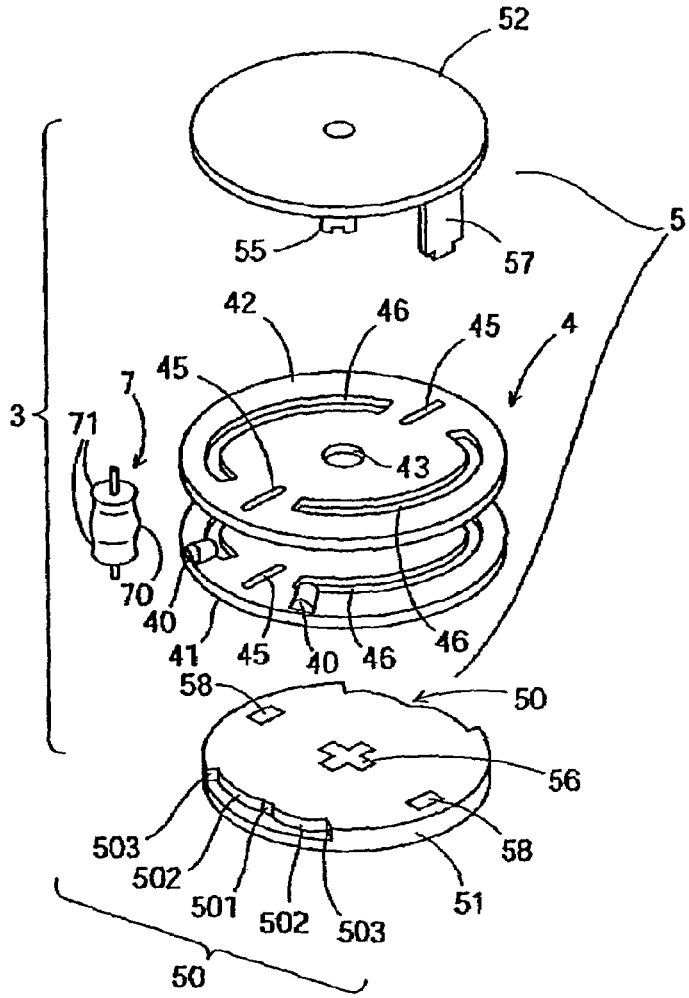
FIG. 4(A) is a perspective view of the rotor of FIG. 3 further disassembled into a roller holder, a pair of end plates, and a roller for squeezing the tube.
Figure 5A:
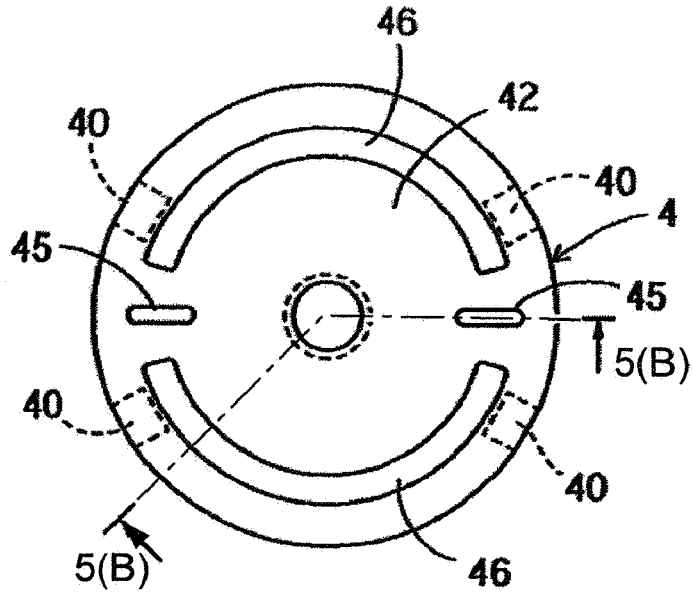
FIG. 5(A) is a plan view of the roller holder.
Figure 5B:
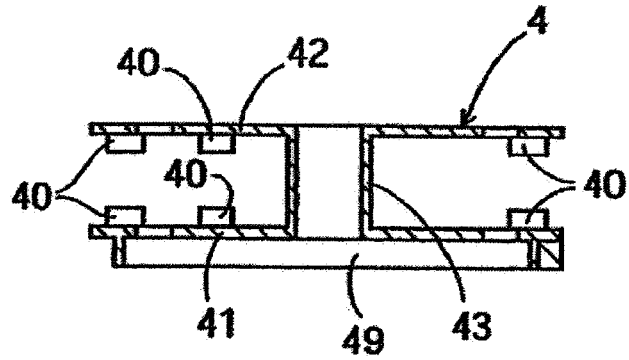
FIG. 5(B) is an A-A' cross section of the roller holder.
Figure 5C:
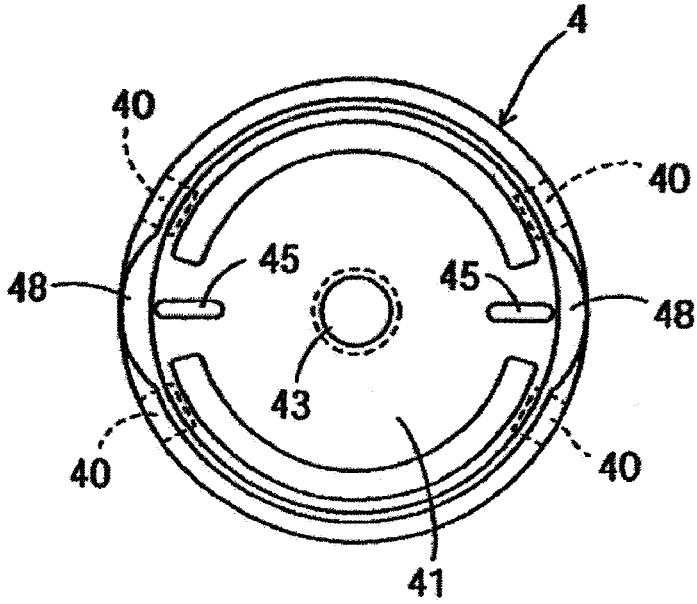
FIG. 5(C) is a bottom view of the roller holder.
Figure 6A:
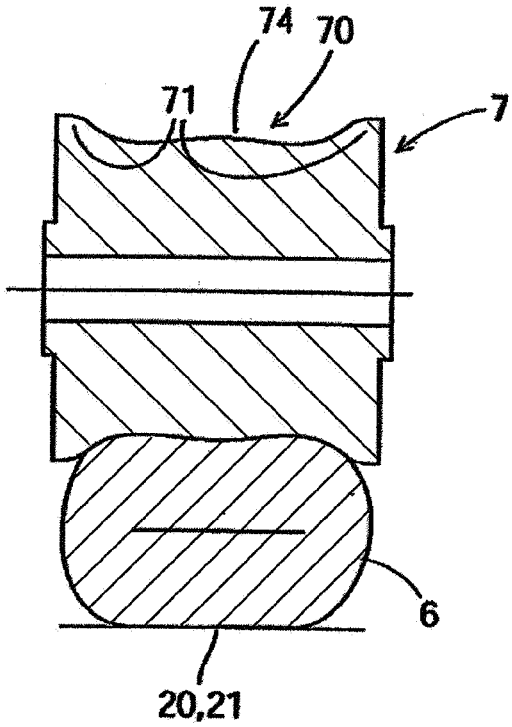
FIG. 6(A) is a side view of the roller for squeezing the tube.
Figure 6B:
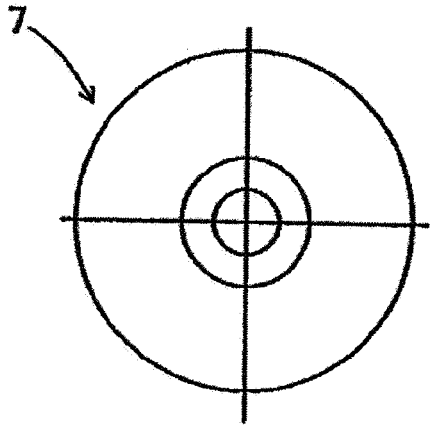
FIG. 6(B) is a plan view of the same.

FIGS. 1(A) (B) are diagrams illustrating a plan view of the major section of the tube type pumping apparatus of this embodiment and a cross section of the pumping apparatus respectively. FIG. 2 is a diagram illustrating the pumping apparatus at the point of initiating transport of liquid from the state illustrated in FIG. 1(A). FIG. 3 is a perspective view of the tube type pumping apparatus in which a casing and a rotor are disassembled. FIGS. 4(A) and (B) are perspective views illustrating the roller of FIG. 3 disassembled into the roller supporting member, a pair of end plates, rollers for squeezing a tube and a perspective view of the supporting plates viewed from the lower end, respectively. FIGS. 5(A), (B) and (C) each is a plan view; A-A' is a cross sectional view, and the bottom view of the roller supporting member. FIGS. 6(A) and (B); each is a side view and a plan view of a roller for squeezing a tube respectively. In FIGS. 1(A) and 2, the cam surface is marked with hatch lines rising up toward the right; the engagement plate portion is marked with hatch lines declining toward the right.

Figure 4B:
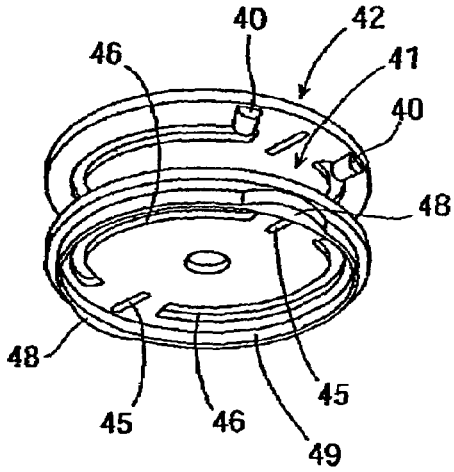
FIG. 4(B) illustrates one of the two supporting plates that is arranged at the lower level, viewed from the lower level.

In FIGS. 1(A), (B), FIGS. 2, 3, and 4, the tube type pumping apparatus 1 comprises: a casing 2 having a rectangular cross section; a rotor 3 rotatably housed in housing hole 21 having a circular cross section on top of casing 2; a resilient tube 6 housed in housing hole 21 together with rotor 3 in such a manner that resilient tube 6 wraps around rotor 3; a decelerating gear mechanism for transmitting torque from stepping motor 11 and the driving source to rotor 3. Resilient tube 6 is positioned between roller 7 held by rotor 3 and the inner wall 20 of housing hole 21.

Casing 2 is made of a plastic material. Two U-shaped holes 28 (two holes together provide a U-shaped cross section as illustrated in FIG. 1(A)) for pulling out resilient tube 6 are provided at one of the four sides of casing 2. Metallic flat spring 29 is fixed onto the inner wall. In casing 2, a circular recess is provided in the center of housing hole 21 and shaft 23 stands out in the center of the circular recess.

Stepping motor 11 is arranged at the bottom of casing 2 and pinion 12 is attached to the output shaft of stepping motor 11. Gear 13 meshes with pinion 12 and gear 14 provided on the upper end of gear 13 meshes with gear 15.

Rotor 3 is described herein. Rotor 3 is constructed with a roller such as squeezing member, roller holder 4, two rollers 7 for squeezing a tube, and a cam member 5.

In light of the above members, roller holder 4 is integrally constructed with a circular first supporting plate 41, a circular second supporting plate 42, and a cylinder portion 43 which links first supporting plate 41 and second supporting plate 42 at the center thereof as illustrated in FIGS. 5(A), (B), and (C).

Each of the first supporting plate 41 and second supporting plate 42 have two circular channels 46 which are circumferentially cut out and two elongated holes 45 extending in a radial direction at the point sandwiched between the ends of circular channel 46. Two circular channels 46 are provided symmetric to the center of the circle on either the first supporting plate 41 or the second supporting plate 42.

Two elongated holes 45 are also provided symmetric to the center of cylindrical portion 43. First supporting plate 41 and second supporting plate 42 are positioned in such a manner that circular channel 46 on first supporting plate 41 and circular channel 46 on second supporting plate overlap each other and elongated hole 45 of first supporting plate 41 and elongated hole 45 of second supporting plate 42 overlap each other.

Under supporting plate 41, which is positioned below second supporting plate 42, a first end plate 51 is provided and is surrounded by circular plate portion 49. In this embodiment, regulating projections 48 and semicircular bays along the outer circumference of circular plate portion 49 are provided at the same angular position as elongated hole 45; near the points where two rollers 7 are supported.

In roller holder 4 thus configured, both ends of rotary center axis 75 of roller 7 for squeezing a tube are inserted into elongated holes 45 of first supporting plate 41 and second supporting plate 42, thereby supporting the two rollers 7 at positions symmetric to the center of cylindrical portion 43. In this state, rollers 7 can rotate around rotary center axis 75 and are also movable in the radial direction within the region in which elongated hole 45 is provided.

Here, roller 7 which is a squeezing member has a curvature on roller surface 70 (squeezing surface) as illustrated in the exploded views in FIGS. 6(A) and (B). This embodiment shows an example where both ends of roller 7 are provided with a raised portion 71 that gradually becomes thicker in the width direction wherein the center portion 74 is eroded.

In other words, to increase the life of a resilient tube, unlike those simple cylindrical rollers of conventional technology, rollers are provided with a squeezing surface with curvatures illustrated in FIGS. 6(A) and (B) to mitigate stress centered around both ends of a resilient tube during squeezing.

As further illustrated in FIGS. 5(A), (B), and (C), rib-like tube position regulating projections 40 serving as tube position regulating means are provided at the front end and rear end of roller 7 in such a manner that they limit positions of resilient tube 6 within the region defined by the circumferences of first supporting plate 41 and second supporting plate 42 and by the center of roller surface 70 in the width direction.

Again in FIGS. 1(A) and (B), 2, 3, and 4, cam member 5 comprises: a circular first end plate 51 provided at the lower end thereof, and circular second end plate 52 provided at the upper end thereof: first end plate 51 is arranged under roller holder 4; second end plate 52 is arranged above roller holder 4; connecting cylinder 55 projecting downward from the center of second end plate 52 is inserted into hole 56 provided at the center of first end plate 51 through cylindrical portion 43 of roller holder 4 such that first end plate 51 and second end plate 52 are linked while sandwiching roller holder 4 therebetween.

As illustrated in FIG. 3, second end plate 52 has two engagement plates 57 projecting downward; first end plate 51 has hole 58 for fitting engagement plate 57 thereto. As illustrated in FIG. 4, first end plate 51 and second end plate 52 are connected putting roller holder 4 therebetween by letting engagement plate 57 into circular channel 46 that is provided on both first supporting plate 41 and second supporting plate 42, followed by fitting the lower end of engagement plate 57 to hole 58 provided on first end plate 51.

In this state, both ends sticking out through first supporting plate 41 and second supporting plate 42 correspond to the portion where cam surface 50 is provided on the inner surface (upper surface) of first end plate 51 and the inner surface (lower surface) of second end plate 52.

Cam surfaces 50 are provided in the same shape such that each of the cam surfaces 50 overlaps each other as a portion having a differential height along the outer circumference on each of the inner surfaces of first end plate 51 and second end plate 52. Now, both cam surfaces 50 are made up with an initial cam surface 501 provided at the center in a radial direction; two squeezing cam surfaces 503 at both ends of initial cam surface 501 toward the outside in a radial direction, and two intermediate cam surfaces 502 having tapered surfaces that link initial cam surface 501 and the two squeezing cam surfaces 503.

In the tube type pumping apparatus having this configuration, when resilient tube 6 is wrapped around outer circumference of rotor 3, resilient tube 6 is provided with roller 7 that is inside rotor 3 in such a manner that rotor 3 and resilient tube 6 are housed in housing hole 21 of casing 2. At this stage, shaft 23 is inserted into linking cylinder 55 and gear 15 is provided under first end plate 51 and is meshed with gear 14 that transmit torque output from stepping motor 11.

In this state, both ends of rotary center axis 75 of roller 7 are at a point corresponding to the point where initial cam surface 50 is, as illustrated in FIG. 1(A); roller 7 is at a point toward the center in a radial direction, not in the position to squeeze resilient tube 6. Regulating projection 48 of roller holder 4 touches flat spring 29; thereby applying a regulating force to roller holder 4.

Stepping motor 11 is actuated at this stage. The torque is transmitted to cam member 5 via gears 12, 13, 14, and 15, when cam member 5 rotates counterclockwise, for example, thereby moving cam surface 50 relative to both ends of rotary center axis 75 of roller 7. As a result, both ends of rotary center axis 75 of roller 7 slide across intermediate cam surface 502 to run on squeezing cam surface 503. In this state, roller 7 is pushed outside, thereby squeezing resilient tube 6. This operation works the same even when cam member 5 rotates clockwise.

Here, when both ends of rotary center axis 75 of roller 7 slide across intermediate cam surface 502, torque is applied to roller holder 4, however, regulating projection 48 of roller holder 4 touches flat spring 29 and brakes roller holder 4. As a result, roller holder 5 does not rotate together with cam member 5 until both ends of rotary center shaft 75 run onto squeezing cam surface 503. Both ends of rotary center axis 75 thus run on squeezing cam surface 503.

In this state, engagement plate 57 moves within circular channel 46; roller holder 4 does not rotate and cam member 5 rotates. In this idle range of engagement of plate 57, regulating projection 48 of roller holder 4 touches flat spring 29 thereby applying brakes on roller holder 4. Roller holder 4, therefore, does not rotate with cam member 5.

As cam member 5 further rotates and rotary center axis 75 of roller 7 bumps against the wall of squeezing cam surface 503, torque is transmitted from cam member 5 to roller holder 4, thereby moving roller 7 which squeezes resilient tube 6. As a result, roller 7 causes a liquid inside resilient tube 6 to be transported therethrough.

In this embodiment, an engagement mechanism (comprised of flat spring 29, regulating projection 48, first end plate 51, second end plate 52 and cam faces 502,503) is provided to move roller holder 4 and cam member 5 in a related manner after a given idle period elapses as cam member 5 begins to move.

Then, cam member 5 transmits a force to rotate roller holder 4, when regulating projection 48 passes through flat spring 29 by pushing flat spring 29 away. There is no brake on roller holder 4 until regulating projection 48 touches flat spring 29 again.

In this embodiment of the present invention, regulating projection 48 and flat spring 29 together defining a regulating force generator apply the regulating force to roller holder 4 at intervals. In other words, the regulating force works when the timing is right. Until the right timing, there is a possibility that roller holder 4 rotates with the cam member 5 during the period in which the cam surface 50 moves roller 7 from the initial position (inward in a radial direction) to the squeezing position (outward in a radial direction). However, duration of such a mutual rotation between squeezing member holder and the cam member is limited to the period defined by the duration before the arrival of right timing and the moment the regulating force begins working, which is negligibly short. In addition, the regulating force works at intervals, minimizing the torque applied to stepping motor 11, eliminating the need for the use of a larger size (power) motor and a significant increase in motor temperature.

Regulating projection 48 and flat spring 29 break roller holder 4 at intervals, therefore the timing regulating force generation means generates a regulating force at intervals. Wearing of regulating projection 48 and flat 29 is thus minimized, thereby improving reliability of the apparatus.

In this embodiment, roller holder 4 supports (multiple) rollers 7 distanced from each other in the circumferential direction; regulating projection 48 is provided near the points the rollers are supported; flat spring 29 is arranged at a point away from the region within which roller 7 squeezes resilient tube 6 around roller holder 4. In this configuration, even though the timing for applying the regulating force comes while roller 7 still moves squeezing resilient tube 6, at least one roller 7 is away from the point of squeezing resilient tube 6. The load applied to the motor at the moment when the regulating force is generated is minimized.

In addition, flat spring 29 is arranged at a point away from the region within which roller 7 squeezes resilient tube 6: regulating projection 48 and flat spring 29 generate a regulating force when one of the two rollers 7 squeezes resilient tube 6.

As a result, no excessive regulating force is generated when roller holder 4 rotates, thereby minimizing the load applied to stepping motor 11. Burning of stepping motor 11 is thus prevented.

Further, regulating projection 48 and flat spring 29 generate a regulating force in the direction in which roller 7 pushes resilient tube 6. Flat spring 29 applies a force to roller 7 that squeezes resilient tube 6, thereby increasing interaction with the liquid in resilient tube 6 during squeezing. Flat spring 6 also absorbs rebound from resilient tube 6.

Regulating projections 48 are provided near the point where rollers 7 are arranged. The regulating force that regulating projection 48 and flat spring 29 generate works in the direction such that one of the rollers 7 further squeezes resilient tube 6, thereby enhancing interaction with the liquid in resilient tube 6 during squeezing.

In the prior art, the resilient tube accomplishes its task as long as the tube stays in the center of the roller surface. However, when the tube is displaced from the center in the width direction, the resilient tube obtains an extremely large pressure from the raised portion of the roller or the tube may be pinched between the roller edge and the casing. The resilient tube may thus be torn out.

However, as illustrated in FIGS. 6(A) and (B), the present invention overcomes the above problem by providing raised portions 71 having a curvature to both ends of roller surface 70 (squeezing surface) of roller 7 in the width direction. Tube position regulating projections 40 that keep the position of the resilient tube in the center of the squeezing surface is provided both in front of and back of rollers 7 in the width (horizontal) direction. As a result, resilient tube 6 is always positioned in the center 74 in the width direction of roller surface 70, as a result, resilient tube 6 is not squeezed at the edges of rollers 7 or a raised portion 71 of rollers 7. Moreover, tube position regulating projection 40 is arranged both in the front of and the back of roller 7 and resilient tube 6 is located at the center 74 in the width direction of roller surface 70 regardless of the direction in which rollers 7 move. Such damages as wearing out or tearing of resilient tube 6 are unlikely to occur, thereby increasing the life of resilient tube 6.

In the above embodiment, rollers are used as squeezing members. However, other squeezing members may be adopted. The squeezing members are supported on a rotor, thereby moving by rotation in the above embodiment. However, the present invention can be applied to squeezing members that move in a linear fashion or any other type of motion.

As described, in the present invention, the regulating force generation means applies the regulating force to the squeezing member holder at intervals. In other words, the regulating force works when the timing is right. Until the timing arrives, there is a possibility that the squeezing member holder rotates with the cam member during the period in which the cam (surface) moves the squeezing member from the initial position to the squeezing position. However, the duration of mutual rotation between the squeezing member holder and the cam member is limited to the period defined by the moment the right timing is up and the moment the regulating force begins working, which is negligibly short. In addition, the regulating force works at intervals, minimizing the torque applied to the motor. In this configuration, even though the timing for applying the regulating force squeezing member comes while the squeezing member still moves, squeezing the resilient tube, at least one roller is away from the point of squeezing the resilient tube. The load applied to the motor at the moment when the regulating force is generated is minimized. The need for the use of a large sized motor (power) is eliminated and a significant increase in motor temperature is avoided. Further, the regulating force generating means generates a regulating force at intervals, minimizing friction wear of the generation portion that generates regulating force. Reliability of the system is thus improved.

As described above, in the present invention, the squeezing surface of the squeezing member has a curvature and a tube position regulating means for keeping the position of the resilient tube in the center of the squeezing surface in the width (horizontal) direction. As a result, the resilient tube is not squeezed at the edges or a raised portion of the squeezing member. The stress generated at the edges of the resilient tube during squeezing is thus released, thereby enhancing the life of the resilient tube.

The foregoing specific embodiments represent just some of the ways of practicing the present invention. Many other embodiments are possible within the spirit of the invention. Accordingly, the scope of the invention is not limited to the foregoing specification, but instead is given by the appended claims along with their full range of equivalents.

What is claimed is:

1. A tube type pumping apparatus comprising:

a wall;

a resilient tube, provided along said wall having an internal hollow space to be used as a passage; and a squeezing member arranged in such a manner that said resilient tube is sandwiched between said squeezing member and said wall such that said resilient tube is squeezed as said squeezing member moves along said wall, thereby transporting liquid through said resilient tube;

wherein said tube type pumping apparatus further comprises:

a squeezing member holder for holding said squeezing member in such a manner that said squeezing member could change its position between a squeezing position near said wall and an initial position away from said wall;

a cam member having a surface that receives a driving force from a driving source to change positions of said squeezing member between said squeezing position near said wall and said initial position away from said wall;

an engagement mechanism, which causes said squeezing member holder and said cam member to move together after a given idle time elapses from the time said cam member begins to move; and a regulating force generator that provides a regulating force to said squeezing member holder at a time interval as said squeezing member moves.

2. The tube type pumping apparatus as set forth in claim 1 wherein said squeezing member includes one or more rollers; said squeezing member holder is a rotary member having a pair of supporting plates for holding said rollers therebetween; and said resilient tube and said wall are arranged around said squeezing member holder.

3. The tube type pumping apparatus as set forth in claim 2 wherein said regulating force generator is constructed with a regulating projection, which projects toward the outer circumference from said squeezing member holder; and a spring member, which resiliently contacts said regulating projection around said squeezing member holder.

4. The tube type pumping apparatus as set forth in claim 3 wherein a plurality of said rollers are held by said squeezing member holder at points at a distance along said circumference; said regulating projection being near said points where said roller is supported;

wherein said spring member is arranged, at a point around said squeezing member support in such a manner that said squeezing point is kept away from the region in which said rollers squeeze said resilient tube.

5. The tube type pumping apparatus as set forth in claim 4 wherein said regulating force generation means generates a force in the direction in which said regulating force generation means pushes any one of said rollers against said resilient tube.

6. A tube type pumping apparatus comprising:

a wall;

a resilient tube, provided along said wall and having an internal hollow space to be used as a passage; and a squeezing member arranged in such a manner that said resilient tube is sandwiched between said squeezing member and said wall such that said resilient tube is squeezed as said squeezing member moves along said wall, thereby transporting liquid through said resilient tube;

wherein said squeezing member has a squeezing surface with a curvature;

a tube position regulating means provided for said resilient tube for keeping said resilient tube in the center of said squeezing surface when said squeezing member squeezes said resilient tube.

7. The tube type pumping apparatus as set forth in claim 6 wherein said tube position regulating means are arranged at point in the front end and the back end of the forward direction of said squeezing member.

8. The tube type pumping apparatus as set forth in claim 6 wherein said tube type pumping apparatus further comprises:

a squeezing member holder for holding said squeezing member in such a manner that said squeezing member can change its position between a squeezing position near said wall and an initial position away from said wall; and a cam member that transmits a driving force generated by a driving source to a cam surface thereby moving said squeezing member to or from said squeezing position and from or to said initial position.

9. The tube type pumping apparatus as set forth in claim 8 wherein said squeezing member holder has a pair of supporting plates having an elongated hole that is elongated in a radial direction such that the ends of the rotary center axis of said rollers are fitted to said elongated holes;

wherein said resilient tube and said wall are arranged around said pair of supporting plates that are facing each other; projections, which is said tube position regulating means, project from each of the facing surfaces of said pair of supporting plates;

said cam member having a pair of end plates facing each other in such a manner that said pair of end plates sandwich said pair of supporting plates; said end plates having a cam surface formed in such a manner that both ends of said rotary shaft slide on said cam surface; and an engagement mechanism, provided at a point between said cam member and said squeezing holder to cause said squeezing member holder and said cam member to move in a corresponding manner after a given idle time elapses as cam member begins to move; such that said rollers move along said resilient tube and said wall after said rollers appear from said initial position to said squeezing position.

10. A tube type pumping apparatus comprising:

a resilient tube provided along a wall;

a squeezing member positioned to move along the wall to squeeze the resilient tube against the wall, thereby transporting material contained in the resilient tube;

a squeezing member holder that holds the squeezing member;

a cam member whose surface receives a driving force from a driving source to change positions of the squeezing member between an initial position away from the wall and a squeezing position near the wall; and a regulating force generator that provides a regulating force to the squeezing member holder at a transition time interval as the squeezing member moves from the initial position to the squeezing position, the regulating force generator and the cam member acting together to prevent the squeezing member from applying pressure against the resilient tube during the transition time interval.

11. The tube type pumping apparatus as set forth in claim 10 wherein:

the squeezing member includes one or more rollers;

the squeezing member holder is a rotary member having a pair of supporting plates for holding the rollers therebetween; and the resilient tube and the wall are arranged around the squeezing member holder.

12. The tube type pumping apparatus as set forth in claim 11 wherein the regulating force generator includes a regulating projection that projects toward the outer circumference of the squeezing member holder and a spring member that resiliently contacts the regulating projection around the squeezing member holder.

13. The tube type pumping apparatus as set forth in claim 12 wherein the regulating projection is disposed near a point where the corresponding roller is supported by the squeezing member holder.

14. The tube type pumping apparatus as set forth in claim 10 wherein the squeezing member includes a roller having a curved squeezing surface.

15. The tube type pumping apparatus as set forth in claim 10 wherein the squeezing member includes a roller having a curved squeezing surface, the curved squeezing surface having at its both ends a projected portion to maintain the alignment of the resilient tube with the squeezing surface.

* * * * *